United States Patent [19]

Eriksson

[11] 4,002,242

[45] Jan. 11, 1977

[54] VEHICLE CRANES

[75] Inventor: Mats Erik Eriksson, Hudiksvall, Sweden

[73] Assignee: Hiab-Foco Aktiebolag, Hudiksvall, Sweden

[22] Filed: May 21, 1975

[21] Appl. No.: 579,718

[52] U.S. Cl. ..... 212/8 R; 214/75 R; 212/58 R

[51] Int. Cl.[2] ..... B66C 23/00

[58] Field of Search ..... 212/8 R, 55, 58 R, 54; 214/75 R, 75 H

[56] References Cited

UNITED STATES PATENTS

| | | | |
|---|---|---|---|
| 2,828,867 | 4/1958 | Frisk | 212/55 X |
| 3,265,219 | 8/1966 | Sundin | 212/55 X |
| 3,543,944 | 12/1970 | Woodside | 212/55 X |
| 3,554,395 | 1/1971 | Dunbar | 212/55 X |
| 3,854,606 | 12/1974 | Hayes et al. | 214/77 R |

FOREIGN PATENTS OR APPLICATIONS

| | | | |
|---|---|---|---|
| 1,229,263 | 11/1966 | Germany | 214/75 H |
| 37,524 | 10/1969 | Finland | |
| 2,064,117 | 7/1971 | France | |
| 315,089 | 9/1969 | Sweden | |
| 285,653 | 11/1971 | U.S.S.R. | 214/75 H |

*Primary Examiner*—Robert J. Spar
*Assistant Examiner*—R. B. Johnson
*Attorney, Agent, or Firm*—Newton, Hopkins & Ormsby

[57] ABSTRACT

In vehicle-mounted cranes comprising a hoisting arm consisting of two hingedly interconnected arm sections the outer one of which is equipped with a longitudinally displaceable boom, a bracket removably attachable to the outer end of said boom and to which bracket is hingedly connected a rocker arm with a longitudinally displaceable boom with means thereon to support a load, in addition to which two hingedly interconnected links are provided to likewise connect said bracket with said rocker arm. Locking bolts secure said bracket to the first-mentioned boom, whereby the bracket together with the rocker arm and the boom thereon may be dismounted from the rest of the crane as a unit which may be attached to the crane whenever increased lifting height is required.

3 Claims, 5 Drawing Figures

VEHICLE CRANES

BACKGROUND OF THE INVENTION

The present invention relates to vehicle cranes of the kind which are provided with a hoisting arm arranged for swinging movement in the vertical direction relative to the crane stand or post by means of a hydraulic piston-and-cylinder unit. The hoisting arm comprises an inner arm section which is articulated to the post and an outer arm section which is articulated to the inner one and arranged for swinging motion by means of a hydraulic piston-and-cylinder unit and also is provided with a boom arranged for displacement substantially in the longitudinal direction thereof. It is already known to equip cranes of this type with a separate extension boom which is insertable into the ordinary extension boom in order to increase the working area of the crane. When the extension boom is extended to its extreme outer position, the total length of the hoisting arm of the crane does, however, become unproportionate compared with the main crane arm proper and difficulties arise in seizing or depositing goods in those areas of the vehicle loading platform that are positioned closest to the crane post. In addition, handling and maneouvring of loads suspended in the crane become difficult in narrow passages, such as factory halls wherein pillars and machinery sometimes block the way. Although the crane gains considerable reach (service range) and lifting height (elevation) its ordinary rocker arm joint will still, when the main arm is raised, remain at a comparatively limited level and in loading of goods in for instance building yards where walls and ceilings have a considerable height, it is sometimes difficult to lift the load above the walls and the ceiling elements because it is impossible to fold the rocker arm in over the crest of the wall. Attempts have been made to improve the working area of the crane by attaching to the ordinary, displaceable boom of the crane arm, a separate rocker arm which is then permanently secured thereto. The attachment arrangements for the separate rocker arm are, however, very space requiring and as a result the crane arm cannot be "parked" transversely across the vehicle but must be positioned in the longitudinal direction of the vehicle and thus encumbers the available loading space. However, it is required of cranes mounted on vehicles having a loading space thereon that it be possible to park the crane arm transversely across the vehicle in order to make the entire loading space free.

SUMMARY OF THE INVENTION

The drawbacks outlined above are remedied by the present invention. The latter is characterised in that the crane is provided with a bracket attachable at the outer end of the extensible boom and having a rocker arm articulated thereto, which rocker arm may be swung in a vertical plane by a hydraulic piston-and-cylinder unit, a second boom being arranged for displacement in the longitudinal direction of the rocker arm and equipped with means for supporting a load, in addition to which said bracket is connected with said rocker arm not only in a manner known per se via an articulated joint but also by means of two links (or link pairs) which are hingedly interconnected at a point below the first articulated joint, and in that said hydraulic piston-and-cylinder unit is connected both with the rocker arm and with the articulated joint between the links. The rocker arm may be dismounted from and mounted on the main arm of an existing lifting crane in a simple manner so as to give the latter temporarily the required range, particularly for handling goods in construction sites where there is a need for cranes capable of performing heavy lifts with the aid of a crane arm raised to a maximum elevation and where it is desirable to be able to deposit the loads on the other side of a high wall crest. In addition the accessory rocker arm makes the crane versatile and easy to maneouvre and it becomes possible to reach easily the goods positioned on the floor of the loading vehicle proper adjacent the crane post. Finally, it is possible, with the rocker arm in mounted position, to fold the entire crane in such a manner that in its parked position it extends transversely across the vehicle without any portion thereof extending beyond the limits of the maximum loading profile allowed. Owing to the provision of the link arrangement the rocker arm may be swung vertically over an area of 180°.

BRIEF DESCRIPTION OF THE DRAWINGS

The invention will be described more in detail in the following with reference to the accompanying drawings, wherein.

DETAILED DESCRIPTION OF A PREFERRED EMBODIMENT

Figure 1:
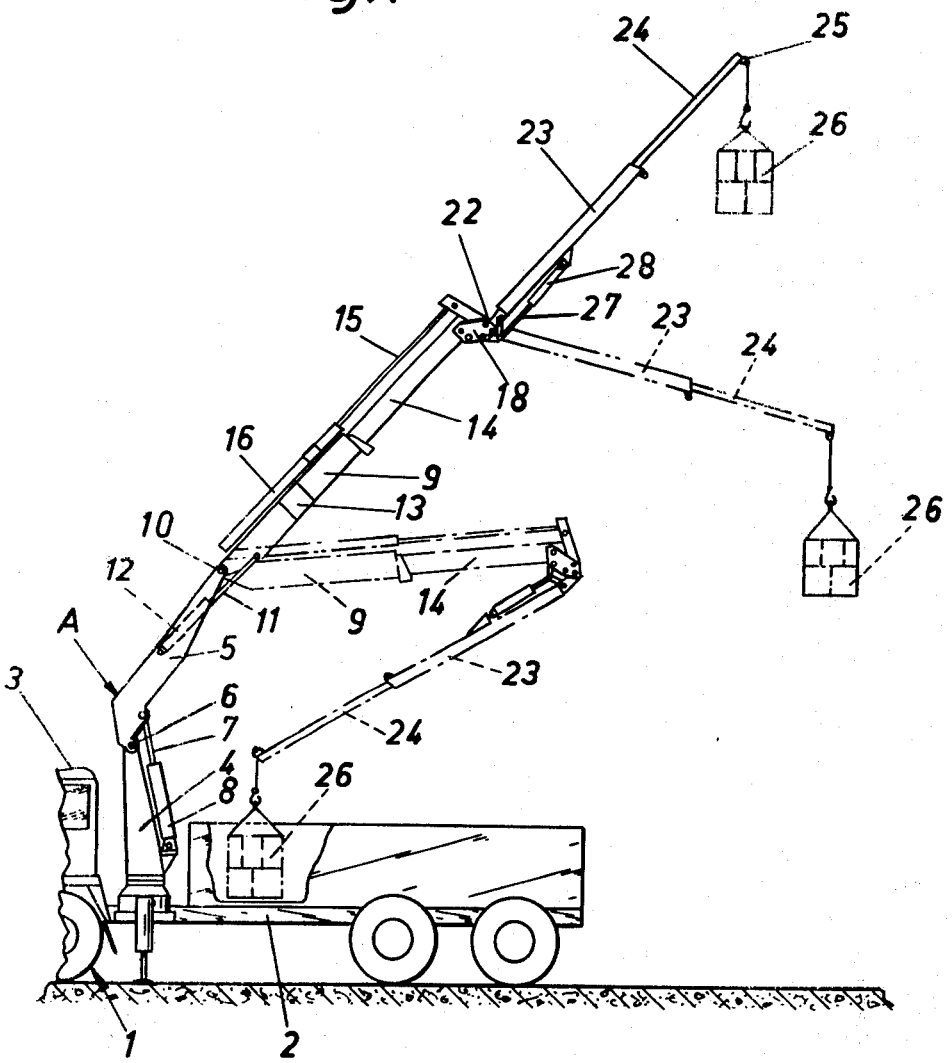
FIG. 1 is a side view of a vehicle-mounted crane provided with an accessory rocker arm in accordance with the invention during operation.

The loading crane A illustrated in the drawings (FIG. 1) is mounted on the chassis frame 2 of a lorry 1 immediately behind the driver's cabin 3. The post 4 of the crane is arranged for turning movement about a vertical shaft. The inner arm section 5 of the crane arm may swing in the vertical direction about a horizontal shaft 6 at the upper end of the post 4 by means of a hydraulic piston-and-cylinder unit 7, 8. The outer arm section 9 of the crane arm is mounted for swinging movement about a horizontal shaft 10 by means of a second hydraulic piston-and-cylinder unit 11, 12. The arm section 9 which is bent at 13 into the shape of an S is provided with a boom 14 which may be displaced by a hydraulic piston-and-cylinder unit 15, 16 in a direction parallel to the longitudinal extension of the arm 9. The outer end of the boom 14 is provided with means 17 to which a load (not shown) may be attached.

The crane described above is of standard design. In accordance with the invention, however, the crane also is equipped with two attachment plates 18, 19 forming a bracket which may be secured to the outer end of the boom 14 by means of horizontal locking bolts 20, 21. In the bracket 18, 19 is mounted the inner end of a rocker arm 23 so as to enable the arm to swing about a horizontal shaft 22, and a second boom 24, movable in the longitudinal direction of the rocker arm 23, supports at its outer end a device 25 in which a load 26 may be secured. The swinging movement of the rocker arm is made possible by means of a hydraulic piston-and-cylinder unit 27, 28 the outer end of which is articulated to the rocker arm 23 and the inner end of which is by means of a bolt 29 connected with the interconnection between two link pairs 30 and 31. The latter are by means of a bolt 32 connected at their opposite ends with the bracket 18, 19 and also by means of a bolt 33 connected with the rocker arm 23. The articulated joint formed by the bolt 29 is positioned below the shaft 22, i.e. the articulated joint between the rocker arm 23 and the bracket 18, 19. Owing to this link connection it becomes possible to swing the rocker arm 23 together with the boom 24 in a vertical direction over an area of appr. 180° with the aid of the hydraulic piston-and-cylinder unit 27, 28.

Figure 2:
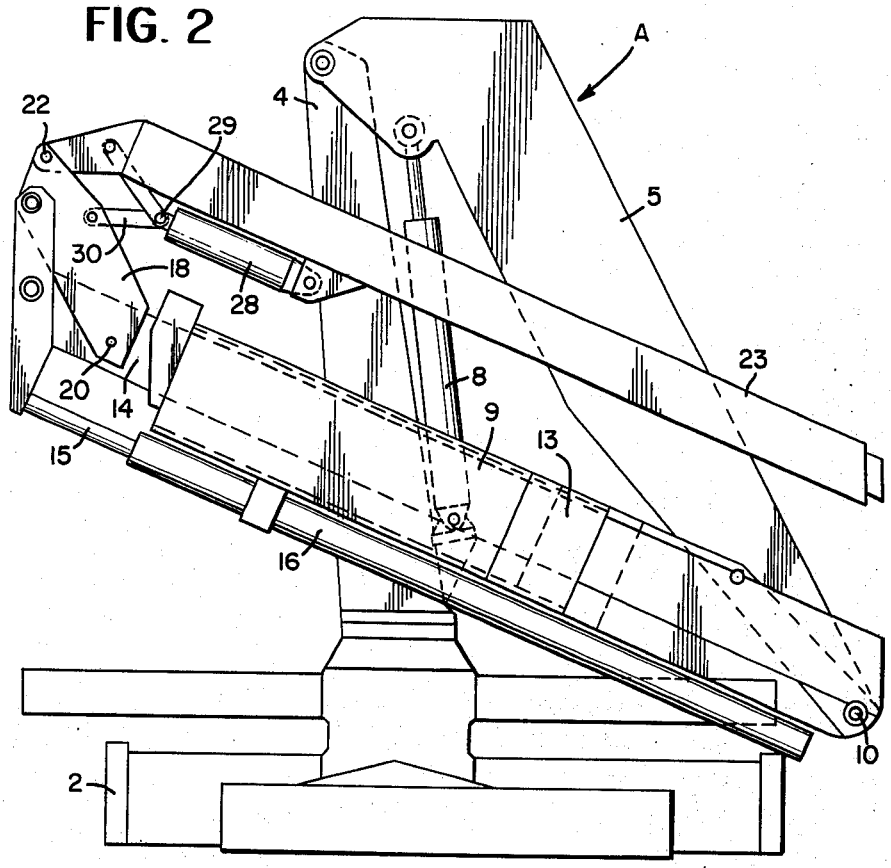
FIG. 2 illustrates on an enlarged scale an end view (as seen in the longitudinal direction of the vehicle) of the crane in parked position.
Figure 5:
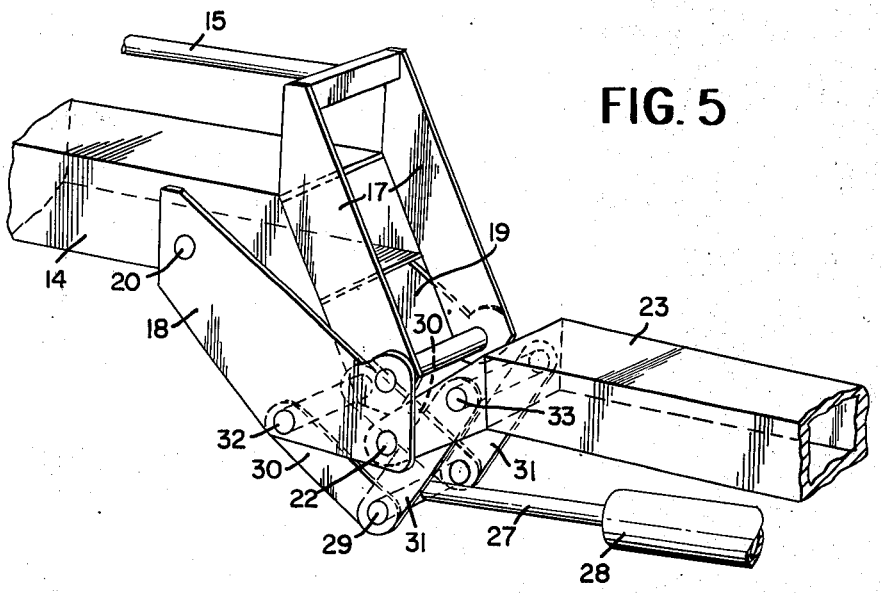
FIG. 5 is a perspective view of the articulated joint in accordance with FIG. 3.
Figure 3:
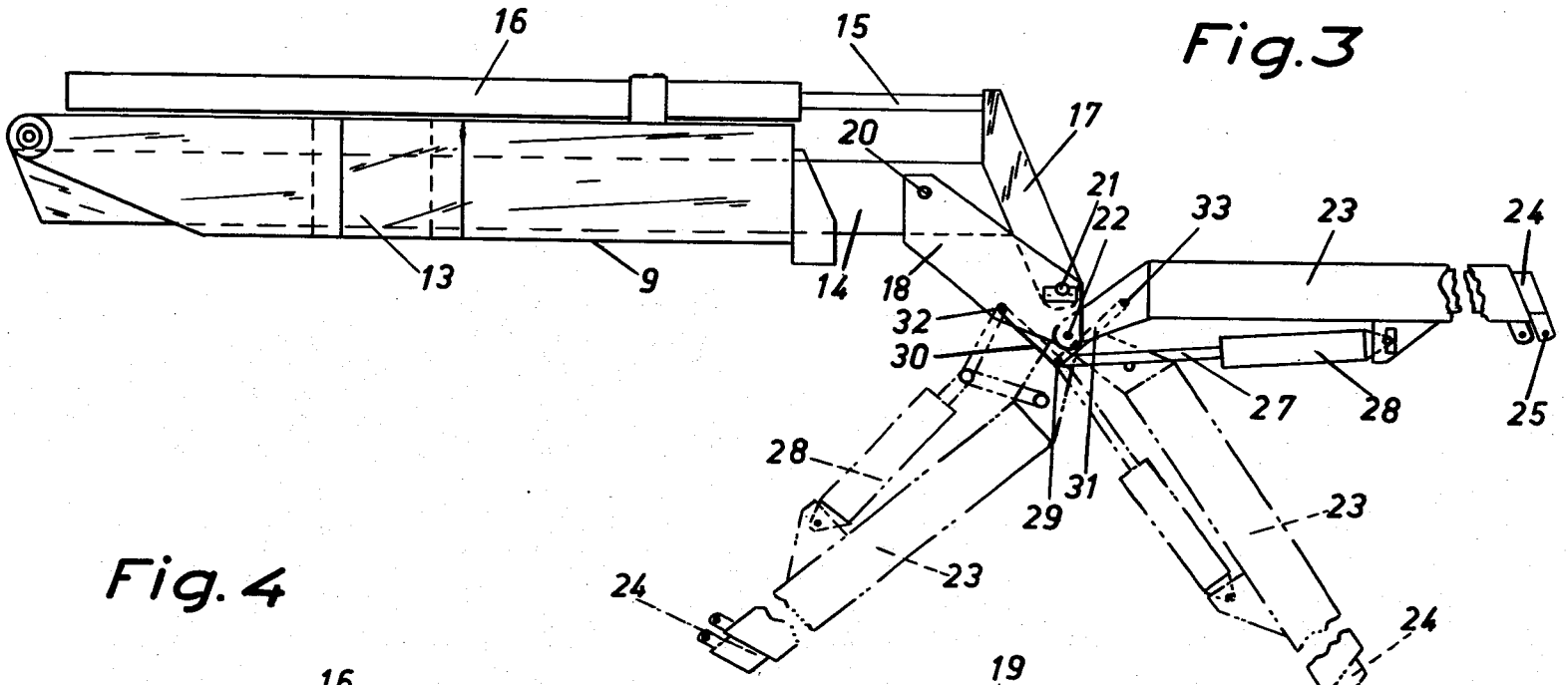
FIG. 3 is a side view of the crane arm as seen at the articulated joint between the main arm and rocker arm of the crane.

As appears clearly from FIG. 1 the crane A has a large reach or radius of service. It is also possible to use the rocker arm 23 together with the boom 24 to lift the load 26 over rather high wall crests. The load 26 may be attached close to the crane post 4. Finally is illustrated in FIG. 2 the manner in which it is possible to fold the crane arm completely such that its various arm sections 5, 9 and 23 may be placed in parking position during driving of the vehicle such that they extend at the rear (or front) side of the post 4 transversely across the vehicle without exceeding the maximum vehicle width allowed. In this position the loading crane requires very little space.

Figure 4:
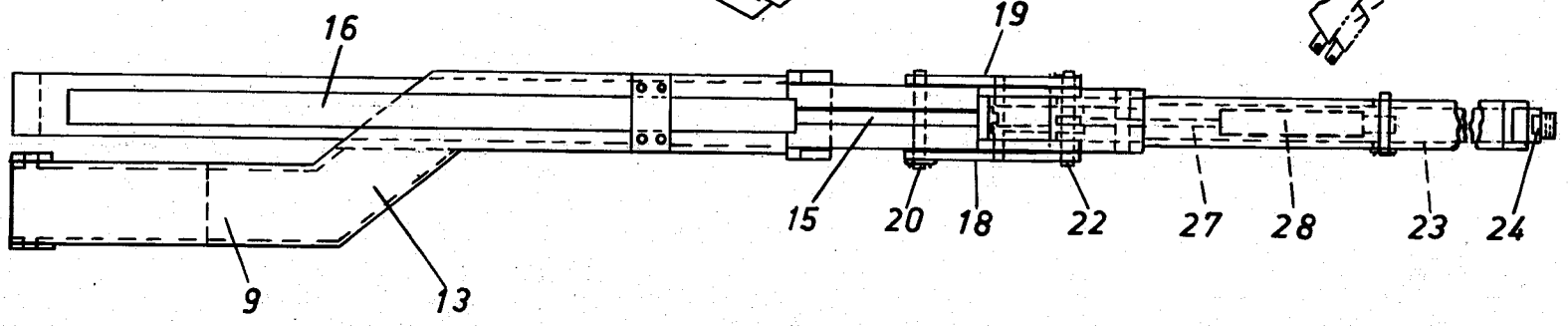
FIG. 4 is a plan view of the crane arm in accordance with FIG. 3.

The embodiment as shown and described is to be regarded as an example only and particularly the hydraulic means to operate the crane may be altered in a variety of ways within the scope of the appended claims. Instead of designing the arm section 9 with an S-bend it is possible to shape the crane post 4 in a corresponding manner in order to allow parking of the crane arm in the manner illustrated in FIG. 2. In this case the boom 14 may be arranged for displacement in the exact longitudinal direction of the arm section 9 and not, as shown in FIG. 4, in parallel thereto.

What I claim is:

1. An improvement in vehicle-mounted cranes of the kind comprising a crane post, a hoisting arm arranged for swinging movement in a vertical direction relative to said crane post a first hydraulic piston-and-cylinder unit for effecting said swinging movement of said hoisting arm, said hoisting arm comprising an inner arm section articulated to said crane post and an outer arm section articulated to said inner arm section, a second piston-and-cylinder unit provided to effect swinging movement of said outer arm section, said outer arm section equipped with a boom displaceable substantially in the longitudinal direction of said arm section, the improvement comprising a bracket which is attachable to the outer end of said boom, a rocker arm hingedly connected to said bracket and arranged for swinging movement in a vertical plane, a third hydraulic piston-and-cylinder unit provided to effect said swinging movement of said rocker arm, a second boom mounted for displacement in the longitudinal direction of said rocker arm and provided with means to support a load in said boom said bracket connected with said rocker arm via an articulated joint, and two links hingedly interconnected at a point below said first-mentioned articulated joint likewise connecting said bracket with said rocker arm said third hydraulic piston-and-cylinder unit, provided to effect said swinging movement of said rocker arm, connected both to said rocker arm and to said articulated joint between said links.

2. An improvement in accordance with claim 1, the improvement comprising two plates spaced laterally apart to form said bracket, and locking bolts provided to removably secure said plates to mutually opposite sides of said first-mentioned boom at the outer end of said boom.

3. An improvement in accordance with claim 1, the improvement comprising two link pairs hingedly interconnected at a point below said first-mentioned articulated joint and connecting said bracket with said rocker arm.

* * * * *